US006237383B1

(12) United States Patent
Albert

(10) Patent No.: US 6,237,383 B1
(45) Date of Patent: May 29, 2001

(54) UNWINDING ADJUSTMENT DEVICE FOR WIRE OR MATERIALS CONTAINING SEVERAL WIRES

(75) Inventor: Eckehard Albert, Berlin (DE)

(73) Assignee: Witels Apparate-Maschinen Albert GmbH & Co. KG, Berlin (DE)

( * ) Notice: Subject to any disclaimer, the term of this patent is extended or adjusted under 35 U.S.C. 154(b) by 0 days.

(21) Appl. No.: 09/445,307

(22) PCT Filed: Jun. 5, 1998

(86) PCT No.: PCT/EP98/03357

§ 371 Date: Dec. 6, 1999

§ 102(e) Date: Dec. 6, 1999

(87) PCT Pub. No.: WO98/55247

PCT Pub. Date: Dec. 10, 1998

(30) Foreign Application Priority Data

Jun. 5, 1997 (DE) ..... 197 23 635

(51) Int. Cl.[7] ..... B21F 23/00; B21F 1/02

(52) U.S. Cl. ..... 72/183; 72/160; 242/417.3

(58) Field of Search ..... 72/183, 160, 162, 72/164, 165; 242/417.3

(56) References Cited

U.S. PATENT DOCUMENTS

| | | | | |
|---|---|---|---|---|
| 2,391,679 | * | 12/1945 | Burge | 72/183 |
| 2,560,204 | | 7/1951 | Andren . | |
| 3,871,205 | * | 3/1975 | Fenton | 72/183 |
| 4,360,137 | * | 11/1982 | Noe | 242/417.3 |
| 4,774,824 | * | 10/1988 | Ritter | 72/160 |
| 4,899,945 | * | 2/1990 | Jones | 242/417.3 |
| 5,031,847 | * | 7/1991 | Tanaka | 242/417.3 |
| 5,139,206 | | 8/1992 | Butler . | |
| 5,248,104 | | 9/1993 | Groos et al. . | |
| 5,366,131 | | 11/1994 | Hoffa et al. . | |
| 5,542,592 | | 8/1996 | Hoffa et al. . | |

FOREIGN PATENT DOCUMENTS

| | | | | |
|---|---|---|---|---|
| 1812802 | * | 6/1970 | (DE) | 72/160 |
| 0 340 322 | | 11/1989 | (EP) . | |
| 0 395 029 B1 | | 1/1997 | (EP) . | |
| 0 769 830 A2 | | 4/1997 | (EP) . | |
| 08 324 885 | | 12/1996 | (JP) . | |

* cited by examiner

*Primary Examiner*—Daniel C. Crane
(74) *Attorney, Agent, or Firm*—Pauley Petersen Kinne & Fejer

(57) ABSTRACT

An unwinding device for wire or materials containing several wires, having a rotating support for a reel, a coil or the like and a folding roller allocated to a processing device. According to this invention, a dancer is positioned between the support and the folding roller. A constant direction for unwinding and winding is maintained in such as way that the unwound or wound material is directed along the same plane of curvature as the curvature of the reel devoid of torque.

22 Claims, 3 Drawing Sheets

UNWINDING ADJUSTMENT DEVICE FOR WIRE OR MATERIALS CONTAINING SEVERAL WIRES

This application is a 371 of PCT/EP98/03357, filed Jun. 5, 1998.

BACKGROUND OF THE INVENTION

1. Field of the Invention

This invention relates to a pay-off reel apparatus for wire or multiple-strand wire material having a pivotal receiver for a reel, a coil or the like, and a bending roller assigned to a processing apparatus.

2. Description of Prior Art

A pay-off reel apparatus is known, from European Patent Reference EP 0 340 322 A1, which feeds coiled material, for example wire from a reel, a coil or a winder to a processing apparatus, and reeling off is frequently performed by drive means.

In a conventional pay-off reel apparatus the feeding force varies constantly, subject to the weight of the reel or coil, simultaneously also impairing entry conditions of the material into the processing apparatus, which then affects the processing quality. With broad reels or coils, the feeding direction towards the feeding roller changes continuously and causes further straining, twisting and deforming, likewise negatively influencing the quality of the subsequent processing operation.

SUMMARY OF THE INVENTION

It is one object of this invention to provide an apparatus and method for reeling off from a spool, coil or the like wherein the prevailing material can be fed to a processing apparatus without its properties fluctuating, such as to develop a pay-off reel straightening apparatus.

This object is attained by a pay-off reel straightening apparatus having the characteristics set forth below in this specification and in the claims.

This invention attains a uniform change of direction while maintaining the original reel curvature of the wire or multiple-strand wire material, a defined elastic change of direction or deflection by the corresponding deflection rollers, and a calculable and constant one-dimensional bending of the wire or multiple-stand wire material after the elastic-plastic deflection or bending at the bending roller. This invention provides optional generation of reverse tension by the bending roller, embraced by the loop of the of the wire or multiple-strand wire material by more than 180° and/or the use of a destressing straightening device, which reliably prevents deformations, helicities, twists or tangling of the wire or multiple-strand wire material. Moments of torsion, causing these effects, are minimized due to an ideally determined spacing between the rollers, as well as a very simple structure of the pay-off reel straightening apparatus. The apparatus of this invention adapts rapidly to the prevailing diameter of the respective material and the corresponding working material of the wire or multiple-strand wire material as well as to existing entry and discharge conditions.

BRIEF DESCRIPTION OF THE DRAWINGS

This invention is explained in detail in what follows by way or a working example with reference to the drawings, wherein.

DESCRIPTION OF PREFERRED EMBODIMENTS

Figure 1:
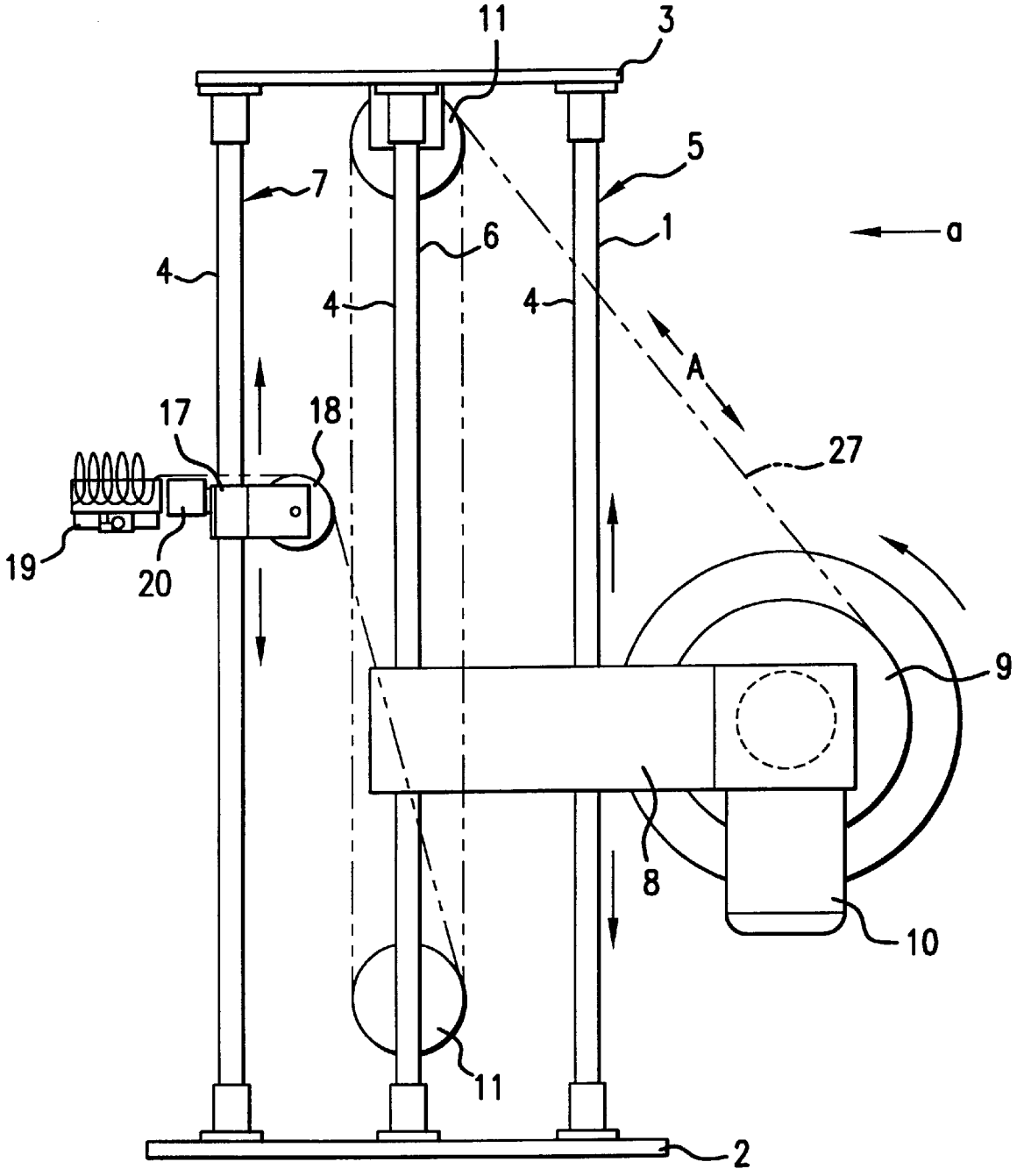
FIG. 1 is a schematic side view of a pay-off reel straightening apparatus.
Figure 2:
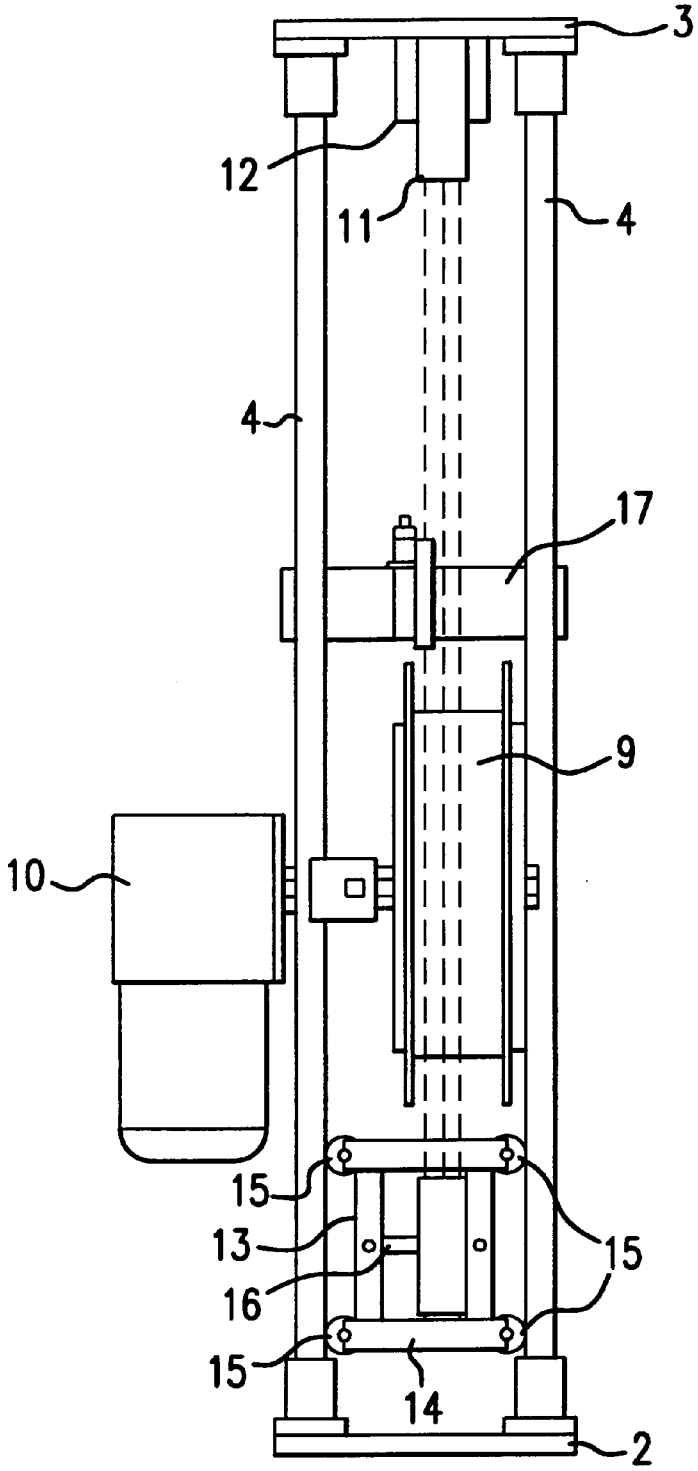
FIG. 2 is a schematic front view of the pay-off reel straightening apparatus according to FIG. 1.

A pay-off reel straightening apparatus of this invention comprises a support frame 1, in one embodiment having a base plate 2, a cover plate 3 and columns 4 provided therebetween. The columns 4 are designed as three column pairs 5, 6 and 7, arranged one behind the other. The columns 4 are connected to the plates 2, 3 in any known way. For reasons of stability, it is also possible to provide a different number of columns 4. A receiving means 8 is fitted to the support frame 1, to accommodate a horizontally arranged reel 9, a coil or a winder. The receiving means 8 may be fitted to the pair of columns 5 or to one column 4 and each of the column pairs 5 and 6 or, if necessary, even to a plurality of columns 4. In the embodiment the receiving means 8 has a drive means 10, which rotates the reel 9. Preferably, the receiving means 8 is mounted on the columns 4 in a level adjustable manner, capable of being locked in any position. Between the columns 4 of the central pair of columns 6 at least one freely pivotal deflection roller 11 is mounted in the region of the cover plate 3. In the embodiment exemplified three deflection rollers 11 are arranged and mounted freely pivotal about a common axis 12. A dancer 13 is provided between the columns 4 of the pair of columns 6 in a manner enabling the dancer 13 to move up and down. The dancer 13 comprises a frame 14 with freely rotatably wheels 15 that are able to roll off along the columns 4 of the pair of columns 6 and are guided, in which it is also possible to have either no guide means, or differently designed guide means. Within the frame 14 an axis 16 is provided, preferably in a center, about which at least one deflection roller 11, the embodiment illustrates three deflection rollers 11, is provided in an adjacent position and in each case freely pivotal. The number of deflection rollers 11 in the region of the cover plate 3 is adapted to the number in the dancer 13. The dancer 13 is adapted to receive weights, not shown, symmetrically along a vertical axis.

On the last pair of columns 7 there is a holding means 17, adapted to be shifted and stopped, in which a pivotal bending roller 18 is mounted. A processing device 19 is also preferably provided on the holding means 17, forming a straightening apparatus.

A spacing A, shown in FIG. 1, between the receiving means 8 for a reel 9 and the first deflection roller 11, between the deflection roller 11 and each of the following deflection rollers 11, between the last deflection roller 11 and the bending roller 18, and between the bending roller 18 and the processing apparatus 19 corresponds to the condition A is equal to or less than $\pi \cdot D$, wherein D is the prevailing diameter of the reel 9 or a preceding deflector roller 11 or the bending roller 18. The diameter of each deflection roller 11 for a defined elastic deflection of the wire or multiple-strand wire material is $$D \geq \frac{dE}{R_{p0.2}}$$

wherein d represents the diameter, E represents the modulus of elasticity, and $R_{p0.2}$ represents the technical yield point of the wire or multiple-strand wire material. In order to bring about constant bending of the wire or multiple-strand wire material in the plane of curvature, the diameter of the bending roller 18 is $$D \geq \frac{dE}{R_{p0.2}}$$

By adapting the diameter of the roller 11 to the diameter and the material properties of the wire or multiple-strand wire material, a deflection is attained, which is only elastic.

The bending roller 18 may have a device, not shown, for applying additional torque. The torque may either be provided as a drive moment or as a braking moment. A reversing motor may be used as a means for providing driving power, but also braking power, preferably transmitting different and adjustable torques. Should only braking moments have to be transmitted, it is also possible to provide a mechanical braking device, in which case preferably dynamometers and control means for monitoring and automatically adhering to a pre-determined applied force may be provided in each case. For this purpose any prior art devices may be used, which are not described in detail.

By using the bending roller 18 as a combined bending and braking roller, the technology of stretcher-and-roller levelling can be applied. In this process, in addition to the bends applied in the straightening apparatus, a tensile stress is superimposed, in which context forward tension is brought about by the necessary transport of the material, while reverse tension is brought about by the braking action of the bending roller 18.

Figure 3:
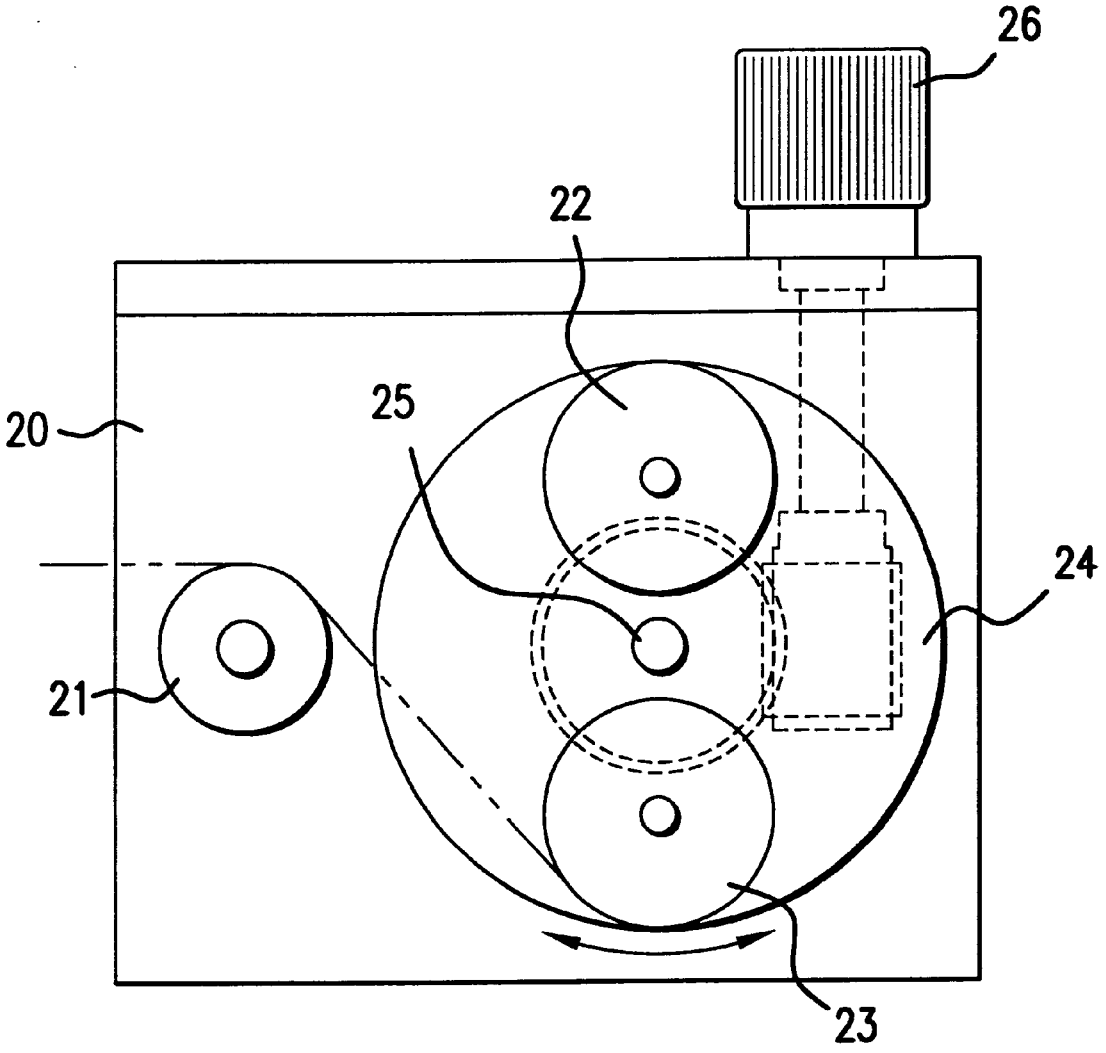
FIG. 3 is a schematic view of a destressing straightening device according to this invention.

Alternatively, a destressing straightening device 20, as shown in FIG. 3, may be used to reverse tension. The destressing straightening device 20 is fitted between the bending roller 18, directly ahead of the processing device 19 and comprises three pivotally mounted rollers 21, 22, 23, of which two rollers 22, 23 have the same diameter and are mounted on a support element 24. The support element 24 is circular and pivotal about its central axis 25, the rollers 22, 23 are arranged symmetrically in relation to one another and about the central axis 25. The support element 24 is mounted about its central axis 25 by any desired adjusting means 26, pivotally in both directions to a defined extent. If the support element 24 is rotated about its central axis 25, the angle of contact on the two rollers 22, 23 fitted thereon changes, and, consequently, the reverse tension action.

For rotation, symmetrical cross-sections, as are generally straightened on such apparatus, the generation and use of forward and reverse tension allows an occurrence of a asymmetrical tension distribution in the material to be straightened which is counter-acted. By setting a balanced ratio of the rates of bending and traction in the overall deformation, it is possible to substantially improve the quality, in particular the straighteness or curvature of wire or multiple-strand wire material.

The apparatus operates in such a manner that material coiled around the reel 9, for example a wire 27, is reeled off the reel 9 by switching on the drive means 10, is guided along the cover plate 3 via the first deflection roller 11, is deflected there and is fed to the deflection roller 11 inside the frame 13. If required, further contacting of further deflection rollers 11 is performed in each case in pairs, guided correspondingly along the cover plate 3 and in the dancer 13. Finally, the end of the wire 27 coiled around the last deflection roller 11 in the dancer 13 is fed to the feeder roller 18 and to the processing apparatus 19.

The drive means, controlled by the dancer 13, ensures feeding with constant force in the downstream processing apparatus 19, regardless of the reel weight. In doing so, the weight of the dancer not only builds up a constant tensile force on the material to be reeled off in the direction of discharge, but also in the reeling off direction. The factors of straightening, constant bending via the bending roller 18, the deflections and the variable weight of the dancer all have an effect on the discharge force. All these factors result in the material, which already has constant properties, entering the processing device 19, resulting ultimately in attaining a higher quality with the processing operation. Due to the deflection by deflection rollers 11, feeding towards the bending roller 18 is also performed uniformly, in which context its coating, where applicable, even its overall design of a material, for example caoutchouc or synthetic material, enhancing the friction coefficient, impairs or prevents twisting about the longitudinal axis of the material.

As already mentioned above, any number of deflections, even any number of pairs of deflection rollers 11 may be provided, the number depending on the prevailing discharge lengths and the desired storing function of the dancer 13.

Apart from bringing about a constant entry curvature, at which the respective material enters a processing apparatus, even in the event of a single or multiple loop passage of the material, the bending roller 18 may serve for stretch straightening and/or even for stretcher-and-bender straightening, provided additional torque is transmitted to the latter.

The level adjustable arrangement of the receiving means 8 as well as of the holding means 17 always allows adaptation to different entry levels of downstream processing devices 19 or to various sizes of reels 9, as well as adaptation to spacing in relation to the first deflector roller 11.

What is claimed is:

1. In a pay-off reel straightening apparatus for a wire material wherein the apparatus has a pivotal receiving means (8) for a reel (9) and has a bending roller (18) assigned to a processing apparatus (19), the improvement comprising: the processing apparatus (19) being a straightening apparatus, a dancer (13) interposed between the receiving means (8) and the bending roller (18), and a constant force for reeling off the wire material and a discharge direction feeding the wire material into the bending roller (18) being maintained so that the wire material is straightened free of torque in a plane parallel to a plane containing a curvature of the reel.

2. In the pay-off reel straightening apparatus according to claim 1, wherein an additional torque is applied to the bending roller (18).

3. In the pay-off reel straightening apparatus according to claim 1, wherein a destressing straightening device (20) is arranged between the bending roller (18) and the processing apparatus (19).

4. In the pay-off reel straightening apparatus according to claim 1, wherein the dancer (13) is fitted in a guide adapted to provide an up movement and a down movement.

5. In the pay-off reel straightening apparatus according to claim 1, wherein the wire material passes in a loop form by more than 180° around the bending roller (18).

6. In the pay-off reel straightening apparatus according to claim 1, wherein at least one of the bending roller (18) and the receiving means (8) are arranged in a level adjustable manner.

7. In the pay-off reel straightening apparatus according to claim 1, wherein the bending roller (18) is coated with a material that enhances a friction coefficient.

8. In a pay-off reel straightening apparatus for a wire material wherein the apparatus has a pivotal receiving means (8) for a reel (9) and has a bending roller (18) assigned to a processing apparatus (19), the improvement comprising: the processing apparatus (19) being a straightening apparatus, a dancer (13) interposed between the receiving means (8) and the bending roller (18), and a constant force for reeling off the wire material and a discharge direction feeding the wire material into the bending roller (18) being maintained so that the wire material is straightened free of torque in a plane parallel to a plane containing a curvature of the reel, and the dancer (13) being a storing means comprising a plurality of deflection rollers (11).

9. In the pay-off reel straightening apparatus according to claim 8, wherein a spacing (A) between the receiving means (8) for the reel (9) and a first said deflection roller (11), between the first said deflection roller (11) and each of the following siad deflector rollers (11), between a last said deflection roller (11) and the bending roller (18), and between the bending roller (18) and the processing device (19) is less than or equal to D which represents a prevailing diameter of one of the reel (9), the preceding aid deflector rollers (11) and the bending roller (18).

10. In the pay-off reel straightening apparatus according to claim 9, wherein a diameter D of each said deflection roller (11) for a defined, elastic deflection of the wire material is governed by $$D \geq \frac{dE}{R_{p0.2}}$$

wherein d represents a diameter, E represents a modulus of elasticity and $R_{p0.2}$ represents a technical yield point of the wire material.

11. In the pay-off reel straightening apparatus according to claim 10, wherein to bring about a constant bending of the wire material in the plane of curvature, a diameter D of the bending roller 18 is governed by $$D \geq \frac{dE}{R_{p0.2}}$$

wherein d represents a diameter, E represents a modulus of elasticity and $R_{p0.2}$ represents a technical yield point of the wire material.

12. In the pay-off reel straightening apparatus according to claim 11, wherein an additional torque is applied to the bending roller (18).

13. In the pay-off reel straightening apparatus according to claim 12, wherein the additional torque is a braking moment.

14. In the pay-off reel straightening apparatus according to claim 13, wherein a destressing straightening apparatus (20) is arranged between the bending roller (18) and the processing device (19).

15. In the pay-off reel straightening apparatus according to claim 14, wherein the destressing straightening device (20)comprises two equally sized pivotal rollers (22, 23) arranged symmetrically with respect to one another on a pivotal support element (25).

16. In the pay-off reel straightening apparatus according to claim 15, wherein the dancer (13) is fitted in a guide adapted to provide an up movement and a down movement.

17. In the pay-off reel straightening apparatus according to claim 16, wherein the wire material passes in a loop form by more than 180° around the bending roller (18).

18. In the pay-off reel straightening apparatus according to claim 17, wherein at least one of the bending roller (18) and the receiving means (8) are arranged in a level adjustable manner.

19. In the pay-off reel straightening apparatus according to claim 18, wherein the bending roller (18) is coated with a material that enhances a friction coefficient.

20. In a pay-off reel straightening apparatus for a wire material wherein the apparatus has a pivotal receiving means (8) for a reel (9) and has a bending roller (18) assigned to a processing apparatus (19), the improvement comprising: the processing apparatus (19) being a straightening apparatus, a dancer (13) interposed between the receiving means (8) and the bending roller (18), and a constant force for reeling off the wire material and a discharge direction feeding the wire material into the bending roller (18) being maintained so that the wire material is straightened free of torque in a plane parallel to a plane containing a curvature of the reel, wherein a spacing (A) between the receiving means (8) for the reel (9) and a first deflection roller (11) of a plurality of deflection rollers (11), between the first deflection roller (11) and each following said deflector roller (11), between a last deflection roller (11) and the bending roller (18), and between the bending roller (18) and the processing device (19) is less than or equal to D which represents a prevailing diameter of one of the reel (9), the deflector rollers (11) and the bending roller (18).

21. In a pay-off reel straightening apparatus for a wire material wherein the apparatus has a pivotal receiving means (8) for a reel (9) and has a bending roller (18) assigned to a processing apparatus (19), the improvement comprising: the processing apparatus (19) being a straightening apparatus, a dancer (13) interposed between the receiving means (8) and the bending roller (18), and a constant force for reeling off the wire material and a discharge direction feeding the wire material into the bending roller (18) being maintained so that the wire material is straightened free of torque in a plane parallel to a plane containing a curvature of the reel, wherein a diameter D of each said deflection roller (11) for a defined, elastic deflection of the wire material is governed by $$D \geq \frac{dE}{R_{p0.2}}$$

wherein d represents a diameter, E represents a modulus of elasticity and $R_{p0.2}$ represents a technical yield point of the wire material.

22. In a pay-off reel straightening apparatus for a wire material wherein the apparatus has a pivotal receiving means (8) for a reel (9) and has a bending roller (18) assigned to a processing apparatus (19), the improvement comprising: the processing apparatus (19) being a straightening apparatus, a dancer (13) interposed between the receiving means (8) and the bending roller (18), and a constant force for reeling off the wire material and a discharge direction feeding the wire material into the bending roller (18) being maintained so that the wire material is straightened free of torque in a plane parallel to a plane containing a curvature of the reel, wherein to bring about a constant bending of the wire material in the plane of curvature, a diameter D of the bending roller 18 is governed by $$D \geq \frac{dE}{R_{p0.2}}$$

wherein d represents a diameter, E represents a modulus of elasticity and $R_{p0.2}$ represents a technical yield point of the wire material.

* * * * *

UNITED STATES PATENT AND TRADEMARK OFFICE

CERTIFICATE OF CORRECTION

PATENT NO. : 6,237,383 B1
DATED : May 29, 2001
INVENTOR(S) : Eckehard Albert

It is certified that error appears in the above-identified patent and that said Letters Patent is hereby corrected as shown below:

Column 3,
Lines 4 and 5, please delete the single equation and insert the following equation:

$$D < \frac{dE}{R_{p0.2}}$$

Claim 11,
Please delete the single equation and insert the following equation:

$$D < \frac{dE}{R_{p0.2}}$$

UNITED STATES PATENT AND TRADEMARK OFFICE

CERTIFICATE OF CORRECTION

PATENT NO. : 6,237,383 B1
DATED : May 29, 2001
INVENTOR(S) : Eckehard Albert

It is certified that error appears in the above-identified patent and that said Letters Patent is hereby corrected as shown below:

Claim 22,
Please delete the single equation and insert the following equation:

$$D < \frac{dE}{R_{p0.2}}$$

Signed and Sealed this

Nineteenth Day of February, 2002

*Attest:*

*Attesting Officer*

JAMES E. ROGAN
*Director of the United States Patent and Trademark Office*